US006596098B1

(12) United States Patent
Nishida et al.

(10) Patent No.: US 6,596,098 B1
(45) Date of Patent: Jul. 22, 2003

(54) WIRE ROD FOR HIGH-FATIGUE-STRENGTH STEEL WIRE, STEEL WIRE AND METHOD OF PRODUCING THE SAME

(75) Inventors: Seiki Nishida, Kimitsu (JP); Atsuhiko Yoshie, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/647,183

(22) PCT Filed: Jan. 28, 2000

(86) PCT No.: PCT/JP00/00488

§ 371 (c)(1),
(2), (4) Date: Sep. 27, 2000

(87) PCT Pub. No.: WO00/44954

PCT Pub. Date: Aug. 3, 2000

(30) Foreign Application Priority Data

Jan. 28, 1999 (JP) ..... 11-020692

(51) Int. Cl.[7] ..... C22C 38/02; C22C 8/04; C21D 8/06

(52) U.S. Cl. ..... 148/320; 148/333; 148/330; 148/332; 148/336; 148/595; 148/598; 148/599

(58) Field of Search ..... 148/320, 333, 148/598, 599, 595, 332, 336, 330

(56) References Cited

FOREIGN PATENT DOCUMENTS

| | | | |
|---|---|---|---|
| JP | 60-204865 | 10/1985 | |
| JP | 63-20406 | 2/1988 | |
| JP | 63-241136 | 10/1988 | |
| JP | 5-279750 | 10/1993 | |
| JP | 6306481 | * 11/1994 | ..... C12D/1/53 |
| JP | 11-229089 | * 8/1999 | ..... C21D/9/52 |

* cited by examiner

*Primary Examiner*—Deborah Yee
(74) *Attorney, Agent, or Firm*—Kenyon & Kenyon

(57) ABSTRACT

The present invention relates to a wire rod for high fatigue-strength steel wire of small diameter, and a wire rod used in steel wire obtained by twisting these together, a steel wire and a method of producing the same. The wire rod for steel wire and the steel wire have a microstructure obtained by controlled cooling following hot rolling of a steel, containing, in mass %, 0.6–1.3% of C, 0.1–1.5% of Si and 0.2–1.5% of Mn wherein the area ratio of upper bainite measured in a cross-section thereof is 5–50%, the remainder being substantially composed of pearlite. The production method thereof comprises drawing and patenting a wire rod of 5–16 mm diameter having the aforesaid composition to obtain a wire of 0.8–2.8 mm diameter, then austenitizing the wire, quenching it to a temperature range of 500–560° C. for conducting isothermal transformation, thereby adjusting it to a steel microstructure wherein the area fraction of upper bainite is 5–50%, the remainder being substantially composed of pearlite, and then conducting brass plating and drawing to obtain a wire of 0.05–1.0 mm diameter.

20 Claims, 1 Drawing Sheet

WIRE ROD FOR HIGH-FATIGUE-STRENGTH STEEL WIRE, STEEL WIRE AND METHOD OF PRODUCING THE SAME

TECHINCAL FIELD

This invention relates to wire obtained by drawing high-carbon steel after patenting and to a method of producing the wire. More particularly, this invention relates to wire rod used for ACSR (Aluminum Conductor Steel Reinforced Wire)for reinforcement of aluminum power-transmission lines, elevator cable, rope wire, galvanized steel wire and the like, i.e., wire rod that is a product made by drawing, without additional processing, after controlled-cooling following hot rolling and a method of producing the same, steel wire obtained by subjecting a wire rod after hot rolling to draw processing including intermediate patenting, and small-diameter steel wire of high fatigue strength for use in steel cord, hose wire, bead wire, control cables, cut wire, saw wire, fishing line and the like, and to a method of producing the same.

BACKGROUND TECHNOLOGY

In the case of wire made from 0.6% or higher high-carbon steel for use in rope and the like, the product wire rod is generally produced by hot rolling and processing the steel to obtain a wire rod of 5.0–16 mm diameter whose microstructure is thereafter adjusted by controlled cooling. Such wire rods are either made into wire, without additional processing, by drawing for regulation of wire diameter and mechanical properties or made into wire by drawing conducted after another adjustment of microstructure by an intermediate patenting treatment such as lead patenting conducted before drawing or in the course of drawing. Such wires are twisted into rope. They may, as required, be used improving of corrosion resistance by hot-dip galvanizing before drawing or in the course of drawing. On the other hand, small-diameter wire rod used for steel cord and the like is subjected to drawing and intermediate patenting treatment and is then processed into still finer wire of 1.0–2.2 mm diameter. This wire is subjected to final patenting to obtain a pearlite steel wire. Then, after plating, e.g., brass plating, it is processed into 0.15–0.35 mm diameter filament by drawing using drawing dies.

The wire rods used in ropes etc. discussed in the foregoing are desired to exhibit various characteristics, including high strength, excellent drawability and excellent fatigue property. The filaments used in steel cord etc. are made into steel cords with various twist configurations matched to the use conditions. In addition to the various characteristics mentioned above, such twisted steel wires are also desired to have excellent twisting properties.

High-quality wire rods for steel wire, and steel wire, have therefore been developed in response to the foregoing requirements. For example, JP-A-(unexamined published Japanese patent application)60-204865 teaches an ultra-fine wire and carbon steel wire rod for steel cord exhibiting properties of little wire breakage during twisting, high strength, high toughness and high ductility obtained by controlling the Mn content to less than 0.3% to suppress occurrence of overcooled texture after lead patenting and controlling the content of elements such as C, S and Mn. On the other hand, JP-A-63-24046 teaches a wire rod for high-toughness, high-ductility, ultra-fine wire wherein the Si content is set at not less than 1.00% to increase the tensile strength and thereby reduce the drawing rate of the lead patented steel. While these techniques may be able to achieve high strength, they are, however, incapable of providing sufficient fatigue strength. Further, JP-A-63-241136 teaches a method of improving the fatigue strength of steel wire obtained by drawing by adjusting the steel wire microstructure to an upper bainite structure throughout. Since the entire wire microstructure is given bainite, however, this technique is in actuality applied only to patented wire of a diameter of not greater than 1.5 mm. As none of the foregoing technologies achieve both high strength and high fatigue-strength, the development of a steel wire of high strength having high fatigue strength is desired.

DISCLOSURE OF THE INVENTION

The present invention was accomplished in light of the aforesaid current state of the art and, as its purpose, provides a wire rod enabling production of steel wire having unprecedented high fatigue strength at high strength and an ultra-fine wire having high fatigue strength at high strength for use in reinforcing rubber, tires and the like. The gist of the present invention is as follows:

(1) A wire rod for high fatigue-strength steel wire characterized in being a steel containing, in mass %, 0.6–1.3% of C and having a steel microstructure wherein the area fraction of upper bainite measured in a cross-section thereof is not less than 5% and not greater than 50%, the remainder being substantially composed of pearlite.

(2) A wire rod for high fatigue-strength steel wire characterized in being a steel containing, in mass %, 0.6–1.3% of C, 0.1–1.5% of Si and 0.2–1.5% of Mn, the balance being substantially iron and unavoidable impurities, and having a steel microstructure produced by controlled cooling following hot rolling wherein the area fraction of upper bainite measured in a cross-section thereof is not less than 5% and not greater than 50%, the remainder being substantially composed of pearlite.

(3) A wire rod for high fatigue-strength steel wire set out in (2) above, characterized in further containing, as a steel component, in mass %, 0.05–1.2.% of Cr.

(4) A wire rod for high fatigue-strength steel wire set out in (2) or (3) above, characterized in further containing as a steel component, in mass %, 0.005–0.1% of V.

(5) A wire rod for high fatigue-strength steel wire set out in any of (2) to (4) above, characterized in further containing as steel component(s), in mass %, one or more of 0.005–0.1% of Al, 0.002–0.1% of Ti and 0.0005–0.01% of B.

(6) A wire rod for high fatigue-strength steel wire set out in any of (2) to (5) above, characterized in further containing as a steel component, in mass %, 0.05–1.0% of Ni.

(7) A wire rod for high fatigue-strength steel wire set out in any of (2) to (6) above, characterized in further containing as a steel component, in mass %, 0.05–1.0% of Cu.

(8) A wire rod for high fatigue-strength steel wire set out in any of (2) to (7) above, characterized in further containing as a steel component, in mass %, 0.001–0.1% of Nb.

(9) A high fatigue-strength steel wire characterized in being obtained by drawing a wire rod set out in any of (1) to (8) above.

(10) A drawn high fatigue-strength steel wire characterized in having a steel composition set out in any of (1) to (8 ) above and having a steel microstructure wherein the area fraction of upper bainite measured in a cross-section thereof is not less than 5% and not greater than 50%, the remainder being substantially composed of pearlite.

(11) A high fatigue-strength steel wire obtained by drawing a wire rod or a heat-treated wire, characterized in having a steel composition set out in any of (1) to (8) above and having a steel microstructure wherein the area fraction of upper bainite measured in a cross-section thereof is not less than 5% and not greater than 50%, the remainder being substantially composed of pearlite.

(12) A method of producing a high fatigue-strength steel wire characterized in working under a true strain of not less than 1, preferably not less than 2, a wire rod or heat-treated wire characterized in having a steel composition set out in any of (1) to (8) above and having a steel microstructure wherein the area fraction of upper bainite measured in a cross-section thereof is not less than 5% and not greater than 50%, the remainder being substantially composed of pearlite.

(13) A method of producing a drawn wire rod for high fatigue-strength steel wire characterized in hot-rolling a billet containing the steel components set out in any of (1) to (8) above into a wire rod of 5–16 mm diameter, next immersing the wire rod from austenite temperature region in a fused-salt bath of a temperature not lower than 450° C. and not higher than 55° C. and then in succession completing transformation in a fused-salt bath of not lower than 500° C. and not higher than 600° C. to obtain a steel microstructure wherein the area fraction of upper bainite measured in a cross-section thereof is not less than 5% and not greater than 50%, the remainder being substantially composed of pearlite.

(14) A method of producing a high fatigue-strength steel wire characterized in hot-rolling a billet containing the steel components set out in any of (1) to (8) above into a wire rod of 5–16 mm diameter, drawing and patenting the wire rod to obtain a wire of 0.8–2.8 mm diameter, thereafter heating the wire to not lower than 800° C. to transform to an austenite, quenching it to a temperature range of 500–560° C. for conducting isothermal transformation, thereby adjusting it to a steel microstructure wherein the area fraction of upper bainite is not less than 5% and not greater than 50%, the remainder being substantially composed of pearlite, and then after brass plating drawing it to a wire of 0.05–1.0 mm diameter.

BEST MODE FOR CARRYING OUT THE INVENTION

Figure 1:
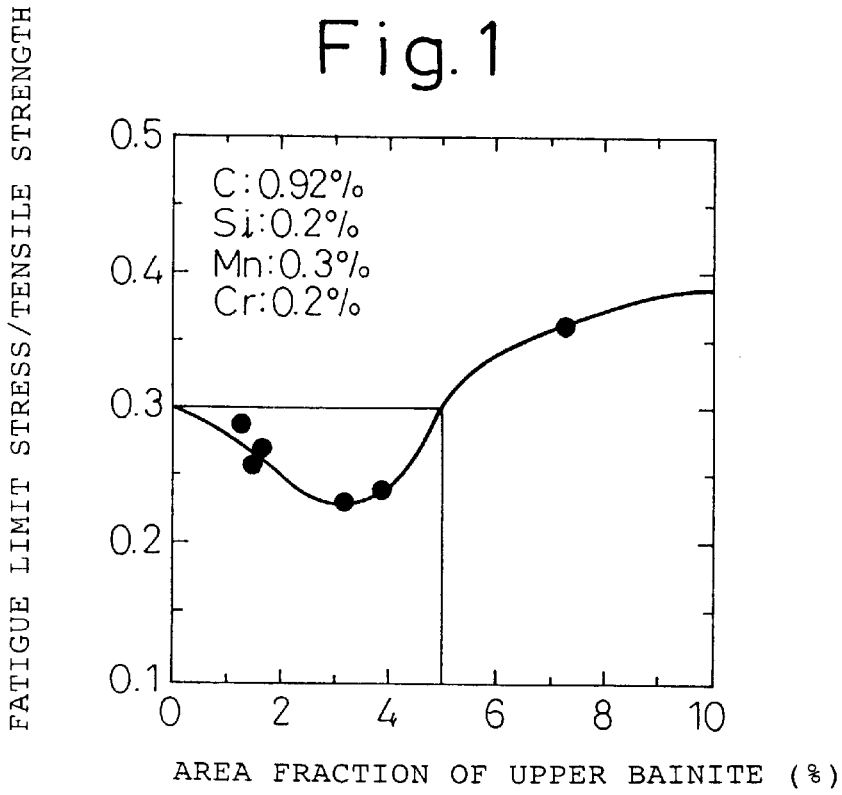
FIG. 1 is a diagram showing how the fatigue strength of a wire rod varies with the area ratio of its upper bainite.

The present invention will now be explained in detail.

The steel composition of the present invention and the reasons for limiting the contents thereof will be explained first. All contents are expressed in mass % (same as weight %).

C is an element effective for strengthening steel and a C content of not less than 0.6% is required to obtain a high-strength steel wire having a pearlite. The upper limit is set at 1.3%, however, because, at too high a content, ductility decreases and drawability is degraded owing to form proeutectoid cementite. In the present invention, moreover, since the microstructure including upper bainite in the steel wire microstructure makes it possible to conduct heat treatment at a relatively lower temperature, the upper limit of C content can be raised.

Si is an element necessary for steel deoxidation. As the deoxidizing effect is insufficient at too low a content, not less than 0.1% is added. Moreover, Si, increases strength after patenting by entering, in solid solution, the ferrite phase of the pearlite formed after heat treatment but, on the other hand, tends to degrade heat treatability. The upper limit is therefore set at 1.5%.

Mn is added at not less than 0.2% in order to secure steel hardenability. However, since addition of a large amount of Mn degrades ductility by causing formation of hard martensite at segregation portions and also delays recovery of ductility in the case of hot-dip galvanizing conducted after drawing, its upper limit is set at 1.5%.

In the present invention, other components such as Cr, V, Al, Ti, B, Ni, Cu and Nb enumerated below can also be appropriately added depending on kind and purpose.

Cr is an element effective for suppressing strength degradation caused by generation of upper bainite. It can be added at not less than 0.05%, the amount above which this effect can be expected, but the upper limit is set at 1.2%, up to which no delay in ductility recovery during plating occurs.

V has an effect of delaying transformation from austenite to pearlite or bainite. It is added at not less than 0.005%, the amount above which the effect of delaying the transformation and facilitating generation of upper bainite is manifested, but the upper limit is set at 0.1%, at which the delay of transformation exerts no adverse influence.

Al has an effect of refining crystal grains at the time of patenting. It is added at not less than 0.005%, the amount above which this refining effect is manifested, but the upper limit is set at 0.1% because of the adverse effect of inclusions with addition of a large amount.

Ti, like Al, has an effect of refining crystal grains at the time of patenting. It is added at not less than 0.002%, the amount above which this refining effect is manifested, but the upper limit is set at 0.1% because addition of a large amount markedly delays pearlite transformation and makes adjustment of the amount of upper bainite difficult.

B, like Al and Ti, has an effect of refining crystal grains at the time of patenting. It is added at not less than 0.0005%, the amount from which this refining effect is manifested, but the upper limit is set at 0.01% because addition of a large amount markedly delays pearlite transformation and makes adjustment of the amount, of upper bainite difficult.

Ni and Cu have an effect of improving mechanical properties after patenting. They are added at not less than 0.05.%, the amount above which this improving effect is manifested, but the upper limit is set at 1.0% because addition of large amounts markedly delays pearlite transformation and affects productivity.

Nb has an effect of refining crystal grains at the time of patenting. It is added at not less than 0.001%, the amount above which this refining effect is manifested, but the upper limit is set at 0.1% because addition of a large amount markedly delays pearlite transformation and makes adjustment of the amount of upper bainite difficult.

The wire rod for steel wire and the method of producing steel wire according to the present invention will now be explained.

The steel adjusted to the aforesaid steel composition is, after steelmaking, continuously cast into blooms or billets.

The blooms are hot rolled into billets. The billets are rolled to a wire rod diameter of 5.0–16 mm by hot rolling and controlled cooling to produce wire rod composed of pearlite with no pro-eutectoid cementite. Water cooling, air-blast cooling, fused-solute cooling, mist cooling or other such cooling method is used for the controlled cooling. Since formation of the aforesaid pro-euctectic cementite markedly impairs the primary processability of the wire rod, controlled cooling must be conducted to prevent formation of pro-euctectic cementite.

The inventors investigated the relationship between fatigue strength and steel composition. FIG. 1 shows how fatigue strength varies with the area fraction of upper bainite in a steel containing 0.92% C, 0.2% Si, 0.3% Mn and 0.2% Cr. Adjustment to an upper bainite of 5% or more improves the post-drawing fatigue strength relative to the case of pearlite only (fatigue limit stress/tensile strength=0.3). When 50% or more upper bainite is included, however, the work hardening rate decreases to make it impossible to obtain a strength equal to that of a pearlite steel. In addition, while fatigue strength is higher in the case of pearlite including upper bainite than in the case of bainite only, the uniform distribution of upper bainite is preferable. The upper bainite in the pearlite is therefore adjusted to not less than 5% and not more than 50%, preferably not less than 5% and not less than 40%. The effect of this is observed in the case where working is imparted at a drawing strain of not less than 1.0 in terms of true strain. Moreover, it was learned that fatigue strength is markedly improved when working is imparted under a true strain of 2.0 or greater. On the other hand, it was learned that the area fraction of the upper bainite in the pearlite must be made 50% or less because a large amount of upper bainite decreases the work hardening rate during drawing and makes it difficult to increase strength. Further, even if upper bainite appears, it is effective to add elements like Cr that prevent a decrease of work hardening, but strength degradation can no longer be avoided even by addition of such elements when the amount exceeds 5%.

The area ratio of the upper bainite referred to here is the area fraction measured in a plane perpendicular to the longitudinal direction of the wire rod or steel wire, i.e., in a cross-sectional plane.

An effective method of generating an appropriate amount of the upper bainite is to immerse the hot-rolled wire rod in an austenite state in a fused-salt solute cooling bath maintained at a temperature of not lower than 450° C. and not higher than 550° C. When the temperature of the fused-salt solute is lower than 450° C., it is difficult to adjust the amount of generated upper bainite to not greater than 50%, and when it is higher than 550° C., it is difficult to ensure a generated amount of upper bainite of not less than 5%.

Then, in succession from the foregoing, the amount of upper bainite is adjusted by immersing the wire rod in a fused-salt solute thermostatic bath maintained at a temperature not lower than 500° C. and not higher than 600° C. to complete the transformation. When the temperature of the fused-salt solute thermostatic bath is set lower than 500° C., it is difficult to keep the amount of upper bainite from becoming greater than 50%, and the temperature must be set at not higher than 600° C. because, when it exceeds 600° C., decomposition of the fused-salt solute occurs to make operation difficult. In the foregoing heat treatment, adjustment of the amount of upper bainite is easier using two baths for appropriate temperature adjustment in the foregoing manner, but there is no need for restriction to two baths and a single bath is sufficient insofar as the heat treatment can be satisfactorily conducted.

The wire rods are next processed into 0.8–2.0 mm diameter wires by drawing and intermediate heat treatment. This wire diameter is not absolute and can of course be modified depending on the wire size finally required. The drawing can be any of drawing using hole dies, roller dies or rolling. The intermediate heat treatment can be any of patenting, tempering or other heat treatment in the temperature range of 800° C. and higher in which strength decreases and ductility recovers.

When wires obtained in this way by drawing high-carbon steel containing upper bainite at an area fraction of not less than 5% and not greater than 50% were subjected to a rotary bending fatigue test to determine the stress indicative of fatigue limit, i.e., the fatigue strength, it was found, as shown in FIG. 1, that they exhibited excellent fatigue strength owing to the increased area fraction of upper bainite.

In the case of a wire obtained by a drawing process that includes patenting between drawings, the final patenting is required to adjust the wire to a microstructure composed of not less than 5% and not greater than 50% of upper bainite and the remainder substantially of pearlite. Lead patenting, fluidized-bed treatment or the like can be used for the final patenting. In any case, it suffices for the equipment to be capable of the patenting that enables adjustment of the amounts of pearlite and bainite so that the microstructure contains upper bainite in pearlite.

Figure 2:
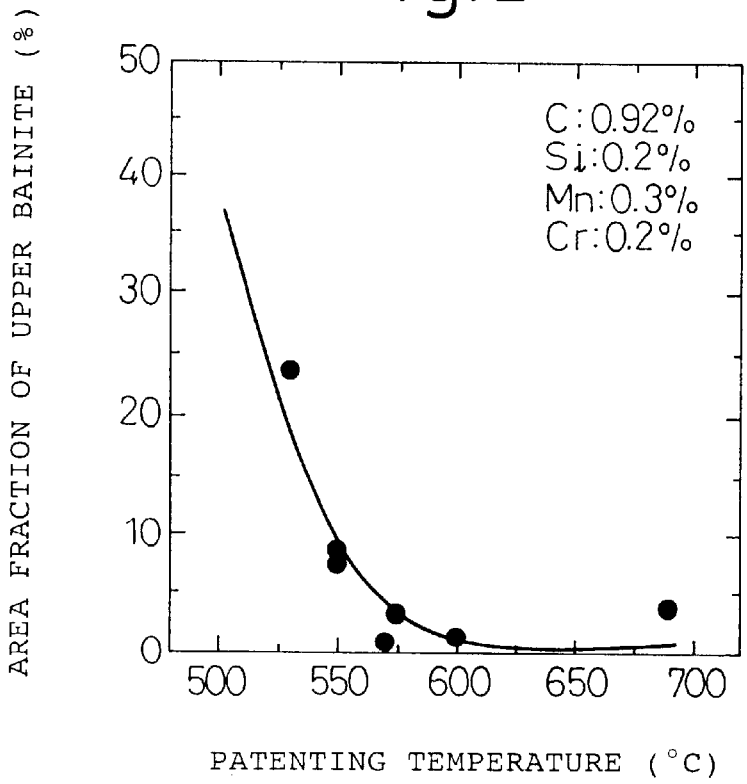
FIG. 2 is a diagram showing how the area ratio of upper bainite varies with patenting temperature.

FIG. 2 shows how the area fraction of upper bainite varies with the isothermal transformation temperature of a steel of the aforesaid composition. As can be seen in FIG. 2, the patenting temperature must be adjusted to not lower than 500° C. and not higher than 560° C. in order to adjust the upper bainite area fraction to not less than 5% and not greater than 50%. Whether or not upper bainite is produced in a high-carbon steel depends on the steel composition, so that it is preferable to carry out adjustment in accordance with variation of transformation nose temperature.

The wire adjusted in microstructure in this manner is thereafter pickled to remove scale, subjected to brass plating, Cu plating or the like as required, and then drawn to increase the strength of steel. Either wet drawing or dry drawing is acceptable. The wire is adjusted to a pearlite containing upper balinite draw to a diameter of 0.05–1.0 mm. At a draw-working strain of 2 or greater, the fatigue strength of the wire having the pearlite containing upper bainite becomes greater than the fatigue strength of pearlite.

The drawing at this time can be effected using drawing dies or roller dies or by cold rolling. When using drawing dies, either a solid lubricant or a fluid lubricant can be used for die lubrication without encountering any problem. The cross-sectional shape of the final filament is circular but a good fatigue property can also be obtained even if it is made elliptical or polygonal. The fatigue limit stress of the drawn filament determined in a rotary bending fatigue test was defined as the fatigue strength. As fatigue strength generally increases with increasing tensile strength, the fatigue limit stress was normalized by dividing it by the tensile strength. The wire obtained in this manner can be made into strand wire and used as reinforcing wire in tires and rubber products.

WORKING EXAMPLES

Example 1

The present invention will now be explained based on working examples.

Invention Steels and Comparative Steels having the chemical compositions shown in Table 1 were produced using a converter, continuously cast into 500 mm×300 mm blooms, and hot rolled into 122 mm square billets. The billets were heated to the 1100–1200° C. temperature range, hot rolled into 5.0–11.0 mm diameter wire rods and, from the austenite region, immediately immersed in fused-salt solute constituting two baths for adjustment to pearlite including upper bainite. The initial cooling bath temperature and ensuing thermostatic bath temperature of the fused-salt solute are shown in Table 2. The mechanical properties and area fractions of the upper bainite observed in cross-sections of the wire rods obtained in the same manner are also shown. The area fractions of the upper bainite were measured using ten secondary-electron images observed at 5,000 magnifications with an SEM.

TABLE 1

Chemical composition of steel specimens (mass %)

| | C | Si | Mn | P | S | Cr | V | Al | Ti | B |
|---|---|---|---|---|---|---|---|---|---|---|
| 1 | 0.62 | 0.20 | 0.51 | 0.015 | 0.012 | 0.10 | 0 | 0.001 | 0.005 | 0 |
| 2 | 0.82 | 0.21 | 0.51 | 0.014 | 0.005 | 0 | 0 | 0.042 | 0 | 0 |
| 3 | 0.82 | 0.20 | 0.48 | 0.016 | 0.012 | 0 | 0 | 0 | 0 | 0 |
| 4 | 0.82 | 1.21 | 0.49 | 0.018 | 0.006 | 0 | 0 | 0.038 | 0 | 0 |
| 5 | 0.92 | 0.21 | 0.30 | 0.013 | 0.007 | 0.21 | 0.05 | 0 | 0.1 | 0 |
| 6 | 1.02 | 0.21 | 0.30 | 0.015 | 0.007 | 0.19 | 0 | 0 | 0 | 0.0008 |
| 7 | 0.98 | 1.20 | 0.29 | 0.014 | 0.004 | 0.21 | 0 | 0 | 0 | 0 |
| 8 | 0.82 | 0.20 | 1.35 | 0.016 | 0.010 | 0 | 0 | 0 | 0 | 0 |
| 9 | 0.92 | 0.19 | 0.29 | 0.013 | 0.008 | 0.40 | 0 | 0 | 0 | 0.01 |
| 10 | 0.92 | 0.17 | 0.32 | 0.014 | 0.012 | 0 | 0 | 0 | 0 | 0 |
| 11 | 0.92 | 0.40 | 0.33 | 0.015 | 0.013 | 0.10 | 0 | 0 | 0 | 0 |
| 12 | 0.92 | 0.48 | 0.25 | 0.015 | 0.014 | 0 | 0.1 | 0.036 | 0 | 0 |
| 13 | 0.92 | 0.21 | 0.35 | 0.015 | 0.008 | 0.10 | 0 | 0 | 0 | 0 |
| 14 | 1.02 | 0.19 | 0.30 | 0.017 | 0.008 | 0.22 | 0 | 0 | 0 | 0 |
| 15 | 1.20 | 0.20 | 0.32 | 0.014 | 0.012 | 0.17 | 0 | 0 | 0 | 0 |
| 16 | 0.82 | 0.19 | 0.48 | 0.013 | 0.007 | 0 | 0 | 0 | 0 | 0 |
| 17 | 0.82 | 0.19 | 0.48 | 0.013 | 0.007 | 0 | 0 | 0 | 0 | 0 |
| 18 | 0.82 | 0.19 | 0.48 | 0.013 | 0.007 | 0 | 0 | 0 | 0 | 0 |

Remarks
1–15: Invention Steels
16–18: Comparative Steels

TABLE 2

Result of wire diameter after rolling, adjustment-cooling conditions and mechanical properties

| | Rolled wire diameter (mm) | DLP treatment conditions: Cooling bath | DLP treatment conditions: Thermo-static bath | T.S (Gpa) | R.A. (%) | Bainite area fraction (%) |
|---|---|---|---|---|---|---|
| 1 | 8.0 | 480° C. | 550° C. | 1.094 | 44 | 8 |
| 2 | 7.0 | 500° C. | 550° C. | 1.142 | 43 | 12 |
| 3 | 5.5 | 510° C. | 550° C. | 1.323 | 45 | 13 |
| 4 | 5.0 | 520° C. | 550° C. | 1.316 | 42 | 18 |
| 5 | 5.5 | 530° C. | 550° C. | 1.353 | 41 | 11 |
| 6 | 5.5 | 490° C. | 550° C. | 1.424 | 44 | 16 |
| 7 | 5.5 | 490° C. | 550° C. | 1.521 | 42 | 17 |
| 8 | 5.5 | 490° C. | 550° C. | 1.387 | 43 | 17 |
| 9 | 11.0 | 450° C. | 550° C. | 1.376 | 42 | 7 |
| 10 | 5.5 | 450° C. | 550° C. | 1.386 | 41 | 28 |
| 11 | 5.5 | 520° C. | 550° C. | 1.354 | 44 | 13 |
| 12 | 5.5 | 520° C. | 550° C. | 1.347 | 42 | 14 |
| 13 | 5.0 | 520° C. | 550° C. | 1.473 | 41 | 20 |
| 14 | 5.5 | 520° C. | 550° C. | 1.521 | 41 | 16 |
| 15 | 5.5 | 520° C. | 550° C. | 1.536 | 39 | 12 |
| 16 | 5.5 | 400° C. | 550° C. | 1.250 | 41 | 60 |
| 17 | 5.5 | 570° C. | 570° C. | 1.221 | 42 | 3 |
| 18 | 5.5 | 450° C. | 450° C. | 1.224 | 42 | 55 |

Remarks
1–15: Invention Steels
16–18: Comparative Steels

The Invention Steels 1–15 in Tables 1 and 2 are steels adjusted to steel chemical compositions and microstructures according to the present invention. On the other hand, Comparative Steel 16 is a case where the cooling bath isothermal transformation temperature was low and the area fraction of the upper bainite was too large. Comparative Steel 17 is a case where the cooling bath temperature was high and the area fraction of the upper bainite was a low 3%. Comparative Steel 18 is a case where the cooling bath isothermal transformation temperature was low and the area fraction of the upper bainite was a high 55%. Steel wires were produced from these wire rods by drawing under the respective conditions shown in Table 3. The tensile strengths (T.S), reduction of area (R.A), and number of twists (N.T.) of the steel wires are shown in Table 4. The normalized values obtained by dividing the fatigue strengths of the respective steel wires, determined using a rotary bending fatigue tester, by their tensile strengths are also shown. All of the Invention Steels exhibited fatigue strengths of high values of 0.3 or higher. On the other hand, the value of the fatigue strength/tensile strength of Comparative Steel 16 was greater than 0.3 but the tensile strength achieved only a low value in comparison with Invention Steel 3 despite the amount of draw-working being the same. Comparative Steel 17 had a low area fraction of upper bainite of 3% so that, while the tensile strength was high, fatigue strength/tensile strength was a low value of less than 0.3. Comparative Steel 18 had a fatigue strength/tensile strength value of greater than 0.3 but the tensile strength achieved only a low value in comparison with Invention Steel 3 despite the amount of draw-working being the same.

TABLE 3

Working of hot-rolled wire rods

| | Working | | | | Draw-working strain (True strain) |
|---|---|---|---|---|---|
| 1 | Drawing | 8.0 mm | → | 3.2 mm | 1.8 |
| 2 | Drawing | 5.5 mm | → | 2.5 mm | 1.6 |
| 3 | Drawing | 5.5 mm | → | 2.5 mm | 1.6 |

TABLE 3-continued

Working of hot-rolled wire rods

| | Working | | | | Draw-working strain (True strain) |
|---|---|---|---|---|---|
| 4 | Drawing | 5.0 mm | → | 2.2 mm | 1.6 |
| 5 | Drawing | 5.5 mm | → | 2.5 mm | 1.6 |
| 6 | Drawing | 5.5 mm | → | 2.5 mm | 1.6 |
| 7 | Drawing | 5.5 mm | → | 2.5 mm | 1.6 |
| 8 | Drawing | 5.5 mm | → | 2.5 mm | 1.6 |
| 9 | Drawing | 11.0 mm | → | 4.5 mm | 1.8 |
| 10 | Drawing | 5.5 mm | → | 2.5 mm | 1.6 |
| 11 | Drawing | 5.5 mm | → | 2.5 mm | 1.6 |
| 12 | Drawing | 5.5 mm | → | 2.5 mm | 1.6 |
| 13 | Drawing | 5.0 mm | → | 2.2 mm | 1.6 |
| 14 | Drawing | 5.5 mm | → | 2.5 mm | 1.6 |
| 15 | Drawing | 5.5 mm | → | 2.5 mm | 1.6 |
| 16 | Drawing | 5.5 mm | → | 2.2 mm | 1.6 |
| 17 | Drawing | 5.5 mm | → | 2.2 mm | 1.6 |
| 18 | Drawing | 5.5 mm | → | 2.2 mm | 1.6 |

Remarks
1–15: Invention Steels
16–18: Comparative Steels

TABLE 4

Mechanical properties of wire after drawing

| | Wire diameter (mm) | T.S (Gpa) | R.A. (%) | N.T. (/100 D) | Dela-mina-tion | Fatigue strength/ Tensile strength |
|---|---|---|---|---|---|---|
| 1 | 3.2 | 1.98 | 48 | 32.7 | None | 0.352 |
| 2 | 2.5 | 1.95 | 48 | 34.9 | None | 0.387 |
| 3 | 2.5 | 1.94 | 46 | 39.8 | None | 0.387 |
| 4 | 2.2 | 1.97 | 45 | 39.7 | None | 0.398 |
| 5 | 2.5 | 2.20 | 44 | 37.8 | None | 0.387 |
| 6 | 2.5 | 2.37 | 42 | 32.5 | None | 0.388 |
| 7 | 2.5 | 2.35 | 48 | 33.5 | None | 0.389 |
| 8 | 2.5 | 2.25 | 49 | 34.4 | None | 0.376 |
| 9 | 4.5 | 2.03 | 42 | 38.3 | None | 0.347 |

TABLE 4-continued

Mechanical properties of wire after drawing

| | Wire diameter (mm) | T.S (Gpa) | R.A. (%) | N.T. (/100 D) | Dela-mina-tion | Fatigue strength/ Tensile strength |
|---|---|---|---|---|---|---|
| 10 | 2.5 | 2.24 | 49 | 35.2 | None | 0.399 |
| 11 | 2.5 | 2.15 | 46 | 34.2 | None | 0.384 |
| 12 | 2.5 | 2.17 | 48 | 35.2 | None | 0.379 |
| 13 | 2.2 | 2.22 | 46 | 34.5 | None | 0.397 |
| 14 | 2.5 | 2.35 | 41 | 36.6 | None | 0.385 |
| 15 | 2.5 | 2.48 | 47 | 38.5 | None | 0.388 |
| 16 | 2.2 | 1.84 | 43 | 34.7 | None | 0.332 |
| 17 | 2.2 | 1.98 | 45 | 33.1 | None | 0.265 |
| 18 | 2.2 | 1.82 | 42 | 32.9 | None | 0.340 |

Remarks
1–15: Invention Steels
16–18: Comparative Steels

Example 2

Invention Steels and Comparative Steels having the chemical compositions shown in Table 5 were produced using a converter, continuously cast into 500 mm×300 mm blooms, and hot rolled into 122 mm square billets. The billets were heated to the 1100–1200° C. temperature range, and hot rolled into 5.5 mm diameter wire rods. The wire rods were drawn into wires of 1.1–2.7 mm diameter by drawing and patenting conducted between drawings as indicated in Table 6. The wire microstructure were then adjusted to pearlite including upper bainite under the patenting conditions shown in Table 7. The bainite area fractions were measured before drawing because more accurate measurement is possible before drawing. The measurements were made with respect to cross-sections of the wires after patenting using ten secondary-electron images observed at 2,000 magnifications with an SEM. The results are shown in Table 7.

TABLE 5

| | C | Si | Mn | P | S | Cr | Ni | Cu | B | Ti | Nb |
|---|---|---|---|---|---|---|---|---|---|---|---|
| 19 | 0.72 | 0.20 | 0.51 | 0.016 | 0.008 | — | — | — | 0.007 | 0.01 | — |
| 20 | 0.82 | 0.21 | 0.51 | 0.014 | 0.010 | — | — | — | — | — | — |
| 21 | 0.92 | 0.20 | 0.48 | 0.012 | 0.006 | — | — | — | — | — | — |
| 22 | 0.92 | 0.21 | 0.49 | 0.013 | 0.008 | — | 0.80 | 0.80 | — | — | — |
| 23 | 0.92 | 0.21 | 0.30 | 0.012 | 0.006 | 0.21 | — | — | — | — | — |
| 24 | 1.02 | 0.21 | 0.30 | 0.012 | 0.008 | 0.19 | — | — | — | — | 0.05 |
| 25 | 0.98 | 1.20 | 0.29 | 0.013 | 0.006 | 0.21 | — | — | — | — | — |
| 26 | 0.82 | 0.20 | 0.82 | 0.013 | 0.003 | — | — | — | — | — | — |
| 27 | 0.92 | 0.21 | 0.29 | 0.012 | 0.009 | 0.40 | — | — | — | — | — |
| 28 | 0.92 | 0.21 | 0.82 | 0.015 | 0.011 | — | — | — | — | — | — |
| 29 | 0.92 | 0.40 | 0.33 | 0.016 | 0.012 | 0.10 | — | 0.05 | 0.001 | — | — |
| 30 | 0.92 | 0.50 | 0.25 | 0.013 | 0.013 | — | — | — | — | — | — |
| 31 | 0.96 | 0.60 | 0.39 | 0.015 | 0.011 | 0.23 | 0.10 | 0.10 | 0.005 | 0.005 | 0.003 |
| 32 | 0.96 | 0.80 | 0.50 | 0.016 | 0.011 | 0.12 | — | — | — | — | — |
| 33 | 1.15 | 0.20 | 0.32 | 0.015 | 0.012 | 0.17 | — | — | — | — | — |
| 34 | 0.72 | 0.20 | 0.50 | 0.013 | 0.008 | — | — | — | — | — | — |
| 35 | 0.82 | 0.20 | 0.50 | 0.012 | 0.007 | — | — | — | — | — | — |
| 36 | 0.92 | 0.20 | 0.50 | 0.015 | 0.008 | 0.19 | — | — | — | — | — |
| 37 | 0.92 | 0.20 | 0.50 | 0.012 | 0.007 | 0.19 | — | — | — | — | — |
| 38 | 0.92 | 0.21 | 0.50 | 0.012 | 0.008 | 0.19 | — | — | — | — | — |

Remarks
19–33: Invention Steels
34–38: Comparative Steels

TABLE 6

| | Working |
|---|---|
| 19 | 5.5 mm → Drawing 1.8 mm |
| 20 | 5.5 mm → Drawing 1.8 mm |
| 21 | 5.5 mm → Drawing 1.8 mm |
| 22 | 5.0 mm → Drawing 1.7 mm |
| 23 | 5.5 mm → Drawing 1.8 mm |
| 24 | 5.5 mm → Drawing 3.2 mm → LP → Drawing 1.45 mm |
| 25 | 5.5 mm → Drawing 3.2 mm → LP → Drawing 1.8 mm |
| 26 | 5.5 mm → Drawing 2.7 mm |
| 27 | 5.5 mm → Drawing 3.2 mm → LP → Drawing 1.7 mm |
| 28 | 5.5 mm → Drawing 3.2 mm → LP → Drawing 1.7 mm |
| 29 | 5.5 mm → Drawing 3.2 mm → LP → Drawing 1.1 mm |
| 30 | 5.5 mm → Drawing 3.2 mm → LP → Drawing 1.4 mm |
| 31 | 5.0 mm → Drawing 3.2 mm → LP → Drawing 1.7 mm |
| 32 | 5.5 mm → Drawing 3.2 mm → LP → Drawing 1.1 mm |
| 33 | 5.5 mm → Drawing 3.2 mm → LP → Drawing 1.7 mm |
| 34 | 5.5 mm → Drawing 1.8 mm |
| 35 | 5.5 mm → Drawing 1.8 mm |
| 36 | 5.5 mm → Drawing 1.8 mm |
| 37 | 5.5 mm → Drawing 1.8 mm |
| 38 | 5.5 mm → Drawing 1.8 mm |

Remarks
19–33: Invention Steels
34–38: Comparative Steels
LP: Lead patenting
FBP: Fluidized-bed patenting

TABLE 7

| | Patenting | | | | | | |
|---|---|---|---|---|---|---|---|
| | Wire diameter (mm) | Type | Temp. (° C.) | T.S. (Gpa) | R.A. (%) | Bainite area fraction (%) | Plating type |
| 19 | 1.8 | LP | 545 | 1.123 | 48.5 | 8 | Brass plating |
| 20 | 1.8 | LP | 540 | 1.330 | 46.5 | 6 | Brass plating |
| 21 | 1.8 | LP | 540 | 1.473 | 47.1 | 12 | Brass plating |
| 22 | 1.7 | LP | 540 | 1.444 | 45.3 | 7 | Brass plating |
| 23 | 1.8 | LP | 550 | 1.390 | 47.6 | 7 | Brass plating |
| 24 | 1.45 | FBP | 540 | 1.511 | 48.2 | 18 | Brass plating |
| 25 | 1.8 | LP | 540 | 1.456 | 48.6 | 8 | Brass plating |
| 26 | 2.7 | LP | 500 | 1.455 | 47.2 | 32 | Brass plating |
| 27 | 1.7 | LP | 520 | 1.532 | 47.1 | 22 | Cu plating |
| 28 | 1.7 | LP | 540 | 1.464 | 45.1 | 12 | Brass plating |
| 29 | 1.1 | FBP | 530 | 1.456 | 47.3 | 18 | Brass plating |
| 30 | 1.4 | LP | 530 | 1.426 | 48.3 | 17 | Brass plating |
| 31 | 1.7 | LP | 550 | 1.475 | 47.2 | 9 | Brass plating |
| 32 | 1.1 | LP | 540 | 1.476 | 47.2 | 11 | Brass plating |
| 33 | 1.7 | LP | 540 | 1.544 | 48.1 | 12 | Brass plating |
| 34 | 1.8 | LP | 575 | 1.233 | 45.3 | 3 | Brass plating |
| 35 | 1.8 | LP | 575 | 1.325 | 46.5 | 2 | Brass plating |
| 36 | 1.8 | LP | 575 | 1.433 | 44.1 | 3 | Brass plating |
| 37 | 1.8 | LP | 600 | 1.433 | 45.2 | 2 | Brass plating |

TABLE 7-continued

| | Patenting | | | | | | |
|---|---|---|---|---|---|---|---|
| | Wire diameter (mm) | Type | Temp. (° C.) | T.S. (Gpa) | R.A. (%) | Bainite area fraction (%) | Plating type |
| 38 | 1.8 | LP | 475 | 1.447 | 46.2 | 95 | Brass plating |

Remarks
19–33: Invention Steels
34–38: Comparative Steels
LP: Lead patenting
FBP: Fluidized-bed patenting The Invention Steels 19–33 are steels adjusted to steel chemical compositions and microstructures according to the present invention. On the other hand, Comparative Steels 34–37 have low upper bainite area fractions because the patenting temperature was high. Comparative Example 38 has a high upper bainite area fraction because the patenting temperature was low. Next, small-diameter steel wires were produced by drawing each of the patented wires to the wire diameter shown in Table 8. The tensile strengths (T.S), reductions of area (R.A), and number of twists (N.T) of the fine steel wires are shown in Table 8. The fatigue limit stresses of the individual wires were determined by subjecting the drawn wires to a rotary bending fatigue test. The normalized values obtained by dividing the fatigue limit stresses by their tensile strengths are also shown in Table 8. The Invention Steels 19–33 were adjusted to the composition range of the present invention and, further, are cases in which the production method was also in accordance with the method of the present invention. It can be seen that they achieved high strength and high fatigue strength. Comparative Steels 34–37 are cases in which the area fraction of upper bainite was lower than in the Invention Steels and, as shown in Table 8, can be seen to have lower fatigue strengths than the Invention Steels. Comparative Steel 38 is a case in which the upper bainite area fraction was higher than in the Invention Steels. Although its fatigue property is only slightly inferior to the level of the Invention Steels, its tensile strength is considerably inferior to Invention Steel 21 of the same steel type.

TABLE 8

| | Wire diameter (mm) | T.S (Gpa) | R.A. (%) | N.T. (/100 D) | Delamination | Fatigue strength/Tensile strength |
|---|---|---|---|---|---|---|
| 19 | 0.3 | 3.23 | 43 | 32.7 | None | 0.363 |
| 20 | 0.3 | 3.44 | 42 | 30.9 | None | 0.325 |
| 21 | 0.3 | 3.69 | 42 | 29.8 | None | 0.373 |
| 22 | 0.3 | 3.54 | 38 | 29.7 | None | 0.362 |
| 23 | 0.3 | 3.80 | 40 | 27.8 | None | 0.368 |
| 24 | 0.2 | 4.64 | 39 | 25.5 | None | 0.395 |
| 25 | 0.3 | 3.94 | 38 | 23.5 | None | 0.385 |
| 26 | 1.0 | 2.46 | 39 | 34.7 | None | 0.394 |
| 27 | 0.3 | 3.67 | 42 | 28.3 | None | 0.387 |
| 28 | 0.3 | 3.71 | 38 | 25.8 | None | 0.392 |
| 29 | 0.15 | 4.49 | 34 | 22.2 | None | 0.402 |
| 30 | 0.2 | 4.21 | 32 | 21.5 | None | 0.399 |
| 31 | 0.3 | 3.76 | 35 | 26.5 | None | 0.400 |
| 32 | 0.15 | 4.76 | 41 | 20.7 | None | 0.402 |
| 33 | 0.18 | 4.00 | 39 | 23.5 | None | 0.411 |
| 34 | 0.3 | 3.08 | 43 | 34.7 | None | 0.275 |
| 35 | 0.3 | 3.43 | 45 | 31.1 | None | 0.268 |
| 36 | 0.3 | 3.82 | 42 | 29.9 | None | 0.275 |

TABLE 8-continued

| | Wire diameter (mm) | T.S (Gpa) | R.A. (%) | N.T. (/100 D) | Dela-mina-tion | Fatigue strength/ Tensile strength |
|---|---|---|---|---|---|---|
| 37 | 0.3 | 3.83 | 41 | 18.9 | None | 0.283 |
| 38 | 0.3 | 3.67 | 40 | 23.9 | None | 0.292 |

Remarks
19–33: Invention Steels
34–38: Comparative Steels

Industrial Applicability

As discussed in the foregoing, the present invention enables easy production of small-diameter steel wire of high fatigue strength for use in steel cord, hose wire, bead wire, control cables, cut wire, saw wire, fishing line and the like, and of high fatigue-strength wire rod and steel wire used for ACSR for reinforcement of aluminum power-transmission lines and the like, elevator cable, rope wire, galvanized steel wire and the like.

What is claimed is:

1. A wire rod for high fatigue-strength steel wire characterized in being a steel containing, in mass %, 0.6 to less than 1.20% of C and having a steel microstructure wherein the area fraction of upper bainite texture measured in a cross-section thereof is not less than 5% and not greater than 30%, the remainder being substantially composed of pearlite.

2. A wire rod for high fatigue-strength steel wire characterized in being a steel containing, in mass %, 0.6% to less than 1.20% of C, 0.1–1.5% of Si and 0.2–1.5% of Mn, the balance being substantially iron and unavoidable impurities, and having a steel microstructure produced by controlled cooling following hot rolling wherein the area fraction of upper bainite texture measured in a cross-section thereof is not less than 5% and not greater than 30%, the reminder being substantially composed of pearlite.

3. A wire rod for high fatigue-strength steel wire set out in claim 2, characterized in further containing, as a steel component, in mass %, 0.05–1.2% of Cr.

4. A wire rod for high fatigue-strength steel wire set out in claim 2, characterized in further containing as a steel component, in mass %, 0.005–0.1% of V.

5. A wire rod for high fatigue-strength steel wire set out in claim 2, characterized in further containing as steel component(s), in mass %, one or more of 0.005–0.1% of Al, 0.002–0.1% of Ti and 0.0005–0.01% of B.

6. A wire rod for high fatigue-strength steel wire set out claim 2, characterized in further containing as a steel component, in mass %, 0.05–1.0% of Ni.

7. A wire rod for high fatigue-strength steel wire set out in claim 2, characterized in further containing as a steel component, in mass %, 0.05–1.0% of Cu.

8. A wire rod for high fatigue-strength steel wire set out in claim 2, characterized in further containing as a steel component, in mass %, 0.001–0.1% of Nb.

9. A high fatigue-strength steel wire characterized in being obtained by drawing a wire rod set out in any of claims 1 to 8.

10. A high fatigue-strength steel wire characterized in being obtained by drawing a wire rod set out in claim 2.

11. A drawn high fatigue-strength steel wire characterized in having a steel composition set out in claim 1 and having a steel microstructure wherein the area fraction of upper bainite texture measured in a cross-section thereof is not less than 5% and not greater than 30%, the remainder being substantially composed of pearlite.

12. A high fatigue-strength steel wire obtained by drawing a wire rod or a heat-treated wire, characterized in having a steel composition set out in claim 1 and having a steel microstructure wherein the area fraction of upper bainite texture measured in a cross-section thereof is not less than 5% and not greater than 30%, the remainder being substantially composed of pearlite.

13. A method of producing a high fatigue-strength steel wire characterized in working under a true strain of not less than 1 a wire rod or heat-treated wire characterized in having a steel composition set out in claim 1 and having a steel microstructure wherein the area fraction of upper bainite texture measured in a cross-section thereof is not less than 5% and not greater than 30%, the remainder being substantially composed of pearlite.

14. A method of producing a drawn wire rod for high fatigue-strength steel wire characterized in hot-rolling a billet containing the steel components set out in claim 1 into a wire rod of 5–16 mm diameter, next immersing the wire rod from austenite temperature region in a fused-salt bath at a temperature not lower than 450° C. and not higher than 550° C. and then in succession completing transformation in a fused-salt bath of not lower than 500° C. and not higher than 600° C. to obtain a steel microstructure wherein the area fraction of upper bainite measured in a cross-section thereof is not less than 5% and not greater than 30%, the remainder being substantially composed of pearlite.

15. A method of producing a high fatigue-strength steel wire characterized in hot-rolling a billet containing the steel components set out in claim 1 above into a wire rod of 5–16 mm diameter, drawing and patenting the wire rod to obtain a wire of 0.8–2.8 mm diameter, thereafter heating the wire to not lower than 800° C. to transform to an austenite, quenching it to a temperature range of 500–560° C. for conducting isothermal transformation, thereby adjusting it to a steel microstructure wherein the area fraction of upper bainite is not less than 5% and not greater than 30%, the remainder being substantially composed of pearlite, and then after brass plating drawing it to a wire of 0.05–1.0 mm diameter.

16. A drawn high fatigue-strength steel wire characterized in having a steel composition set out in claim 2 and having a steel microstructure wherein the area fraction of upper bainite texture measured in a cross-section thereof is not less than 5% and not greater than 30%, the remainder being substantially composed of pearlite.

17. A high fatigue-strength steel wire obtained by drawing a wire rod or a heat-treated wire, characterized in having a steel composition set out in claim 2 and having a steel microstructure wherein the area fraction of upper bainite texture measured in a cross-section thereof is not less than 5% and not greater than 30%, the remainder being substantially composed of pearlite.

18. A method of producing a high fatigue-strength steel wire characterized in working under a true strain of not less than 1 a wire rod or heat-treated wire characterized in having a steel composition set out in claim 2 and having a steel microstructure wherein the area fraction of upper bainite texture measured in a cross-section thereof is not less than 5% and not greater than 30%, the remainder being substantially composed of pearlite.

19. A method of producing a drawn wire rod for high fatigue-strength steel wire characterized in hot-rolling a billet containing the steel components set out in claim 2 into a wire rod of 5–16 mm diameter, next immersing the wire rod from austenite temperature region in a fused-salt bath at a temperature not lower than 450° C. and not higher than 550° C. and then in succession completing transformation in a fused-salt bath of not lower than 500° C. and not higher than 600° C. to obtain a steel microstructure wherein the area fraction of upper bainite measured in a cross-section thereof is not less than 5% and not greater than 30%, the remainder being substantially composed of pearlite.

20. A method of producing a high fatigue-strength steel wire characterized in hot-rolling a billet containing the steel components set out in claim 2 above into a wire rod of 5–16 mm diameter, drawing and patenting the wire rod to obtain a wire of 0.8–2.8 mm diameter, thereafter heating the wire to not lower than 800° C. to transform to an austenite, quenching it to a temperature range of 500–560° C. for conducting isothermal transformation, thereby adjusting it to a steel microstructure wherein the area fraction of upper bainite is not less than 5% and not greater than 30%, the remainder being substantially composed of pearlite, and then after brass plating drawing it to a wire of 0.05–1.0 mm diameter.

* * * * *